United States Patent [19]

Berfield et al.

[11] Patent Number: 4,858,271

[45] Date of Patent: Aug. 22, 1989

[54] WHEEL TYPE VACUUM CLEANER

[75] Inventors: Robert C. Berfield, Jersey Shore; Ronald F. Meland, Muncy, both of Pa.

[73] Assignee: Shop-Vac Corporation, Williamsport, Pa.

[21] Appl. No.: 218,100

[22] Filed: Jul. 12, 1988

[51] Int. Cl.[4] ..... A47L 4/20

[52] U.S. Cl. ..... 15/339; 15/410; 439/456; 439/501

[58] Field of Search ..... 15/410, 339, 323, 333; 439/448–449, 452, 456, 457, 501; 174/46

[56] References Cited

U.S. PATENT DOCUMENTS

| | | | |
|---|---|---|---|
| 1,286,115 | 11/1918 | Rosenfield | 15/410 X |
| 1,528,493 | 3/1925 | Lamb | 439/456 X |
| 1,968,884 | 8/1934 | Gilbert | 174/46 X |
| 2,946,071 | 7/1960 | Nilsson | 15/410 X |
| 3,273,194 | 9/1966 | Jepson et al. | 15/323 |
| 4,222,145 | 9/1980 | Lowder | 15/353 |
| 4,809,397 | 3/1989 | Jacobs et al. | 15/410 X |

FOREIGN PATENT DOCUMENTS

| | | | |
|---|---|---|---|
| 481828 | 3/1952 | Canada | 15/333 |
| 2835301 | 8/1979 | Fed. Rep. of Germany | 15/333 |
| 56183 | 10/1943 | Netherlands | 439/456 |

*Primary Examiner*—Chris K. Moore

*Attorney, Agent, or Firm*—Ostrolenk, Faber, Gerb & Soffen

[57] ABSTRACT

A wheeled vacuum cleaner is provided with an extension projecting upward from a base on which an electric motor powered suction producing device and a floor engaging nozzle are mounted. A handle unit mounted on the upper end of the extension is provided with an anchor that constitutes a strain relief about which a line cord for energizing the motor is looped. A hand operated safety trigger device controls energization of the motor. Pivotally connected to the base is a stand that is movable between a storage position and an active floor engaging position wherein the vacuum cleaner is supported by the stand. The stand is mounted and proportioned so as to be gravity operated automatically to the storage position where it is held by a releasable spring catch while the vacuum cleaner is being used.

21 Claims, 10 Drawing Sheets

WHEEL TYPE VACUUM CLEANER

BACKGROUND OF THE INVENTION

This invention relates to electric vacuum cleaners of a type that is moved across the floor on wheels and includes an external debris collecting porous bag that is considerably larger than the assembled motor, motor driven fan and pickup nozzle of the vacuum cleaner.

The general type of vacuum cleaner in question is disclosed in U.S. Pat. No. 1,843,901 issued Feb. 2, 1932 to L. W. Pardee for an Electric Suction Cleaner. The aforesaid '901 patent describes a device in which the fan impeller rotates in a vertical plane, being driven by a motor having a horizontal output shaft. Other vacuum cleaners of the type illustrated in the '901 patent have impellers that rotate in a horizontal plane, being driven by an electric motor having a vertical output shaft. The latter type of fan arrangement is illustrated in U.S. Pat. No. 1,995,630 issued Mar. 26, 1935 to R. Bass for an Electrically Operated Vacuum Cleaner.

Vacuum cleaners of the type illustrated in the '901 patent are provided with relatively large external debris collecting bags. When the bag is loaded with heavy material, the vacuum cleaner becomes relatively unstable, especially with the bag full and the vacuum cleaner at rest. This unstable condition results when the center of gravity of the device, including the debris laden collection bag, shifts considerably to the rear of the load bearing wheels which support the vacuum cleaner. In an effort to alleviate this tendency toward instability, the device of the '901 patent is provided with load bearing wheel means that are widely spaced in the front to rear direction. This serves to interfere with turning the vacuum cleaner while it is in operation, the spacing between ground and the nozzle inlet varies considerably, and if the vacuum cleaner is not on level ground it will roll easily when not being used.

SUMMARY OF THE INVENTION

In accordance with the instant invention a retractable stand is provided for stabilizing the vacuum cleaner when it is not in use. This stand is pivotally mounted for movement between a storage position and an active position The stand includes an extension having a free end that engages the floor when the stand is in its active position The stand is so constructed and mounted that when the vacuum cleaner is tilted forward the stand is operated automatically by gravity from the active position to the storage position. That is, by tilting the vacuum cleaner forward the floor engaging tip is lifted free of the floor and under the influence of gravity pivots so that initially it moves downward By the time the center of gravity of the stand is in vertical alignment with the pivot for the stand the stand is moving fast enough so that its momentum carries the tip forward and upward until the stand reaches its storage position. At this point the floor engaging tip engages and is held by a spring clip retainer from which it can be released manually and/or by foot manipulation. With the stand in the storage position the floor engaging end is so far from the floor that it does not interfere with normal operation of the vacuum cleaner.

Vacuum cleaners of this type are often connected to a source of electrical power by a commercially available line cord having a receptacle or female connector at one end and a plug or male connector at the other end. The latter is to be inserted into a wall receptacle while the receptacle on the line cord receives and thereby makes electrical contact with the prongs of a plug that is mounted on the vacuum cleaner motor or base. In the prior art the receptacle on the line cord often separated from its cooperating plug. To essentially eliminate this undesirable occurrence the instant invention provides a strain relief means disposed in the region there is a handle that is gripped for operation of the vacuum cleaner This strain relief means includes a stubby upwardly extending post and an eye or guide aperture through which a double thickness of the line cord passes, is reversely bent and then passed around the strain relief post.

As a safety measure, the instant invention controls energization of the fan motor by a triggerlike switch operator which is biased so that the motor control switch is normally open and cannot be closed without disengaging a blocking device from the trigger control. With this arrangement the vacuum cleaner cannot be started accidentally or be permitted to run accidentally while the nozzle entrance is being cleared of debris.

Accordingly, the primary object of the instant invention is to provide a novel construction for a wheel supported vacuum cleaner that is provided with a relatively large external debris collecting bag.

Another object is to provide a vacuum cleaner of this type having a selectively positionable stand to stabilize the vacuum cleaner when the bag is filled with heavy debris which stand is gravity operated automatically to its storage position as soon as the operator tilts the vacuum cleaner forward.

Still another object is to provide a vacuum cleaner of this type having strain relief means that cooperates with a line cord to prevent accidental separation between the female receptacle on the latter and a male plug engaged therewith.

A further object is to provide a convenient means for maintaining the upper end of the bag in its operative position.

A still further object is to provide a trigger-like control switch that is biased open and cannot be closed until a blocking member is moved to a releasing position.

BRIEF DESCRIPTION OF THE DRAWINGS

These objects as well as other objects of this invention shall become readily apparent after reading the following description of the accompanying drawings in which:

In FIG. 8A the safety lever is in its active or blocking position to prevent operation of the operating lever from being depressed, while in FIG. 8B the safety lever is depressed to its inactive position and the operating lever is also depressed.

DETAILED DESCRIPTION OF THE INVENTION

Figure 1:
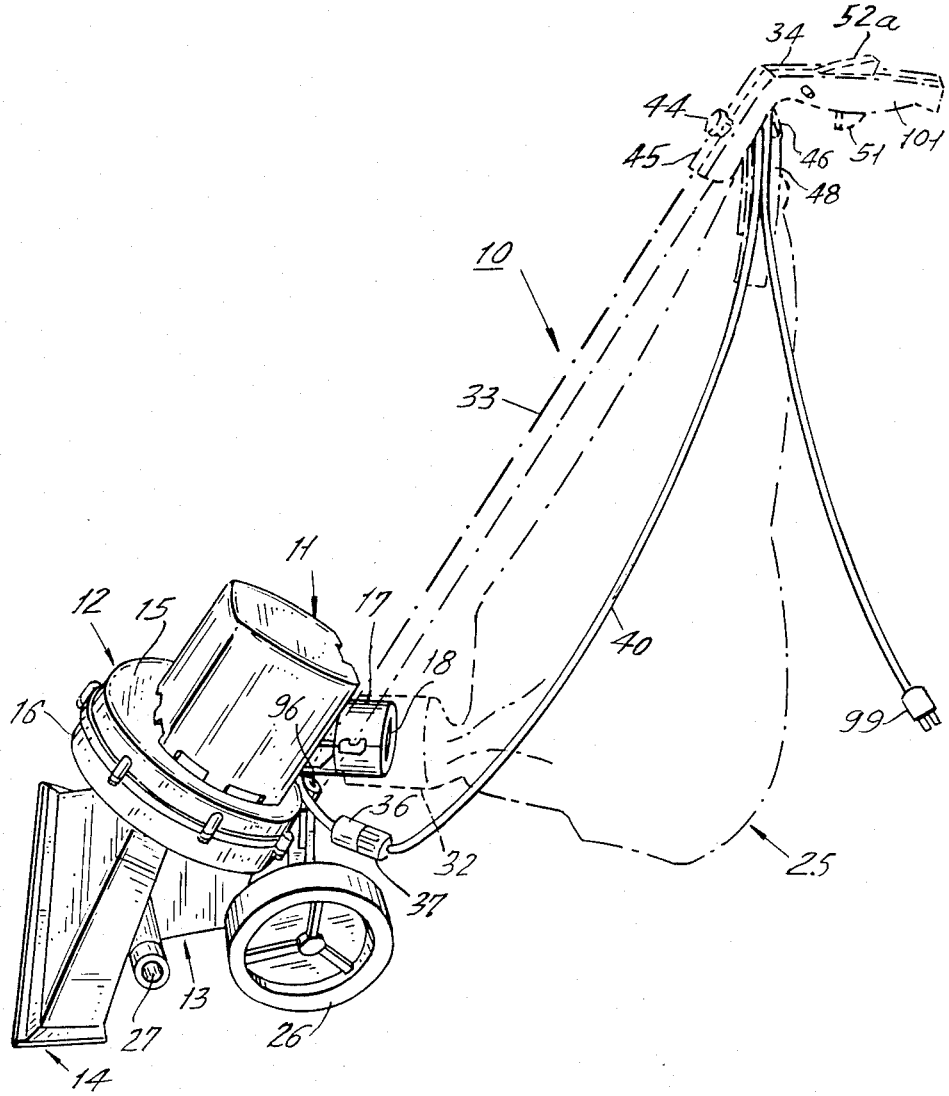
FIG. 1 is a perspective looking forward and at the left side of a vacuum cleaner constructed in accordance with teachings of the instant invention.
Figure 2:
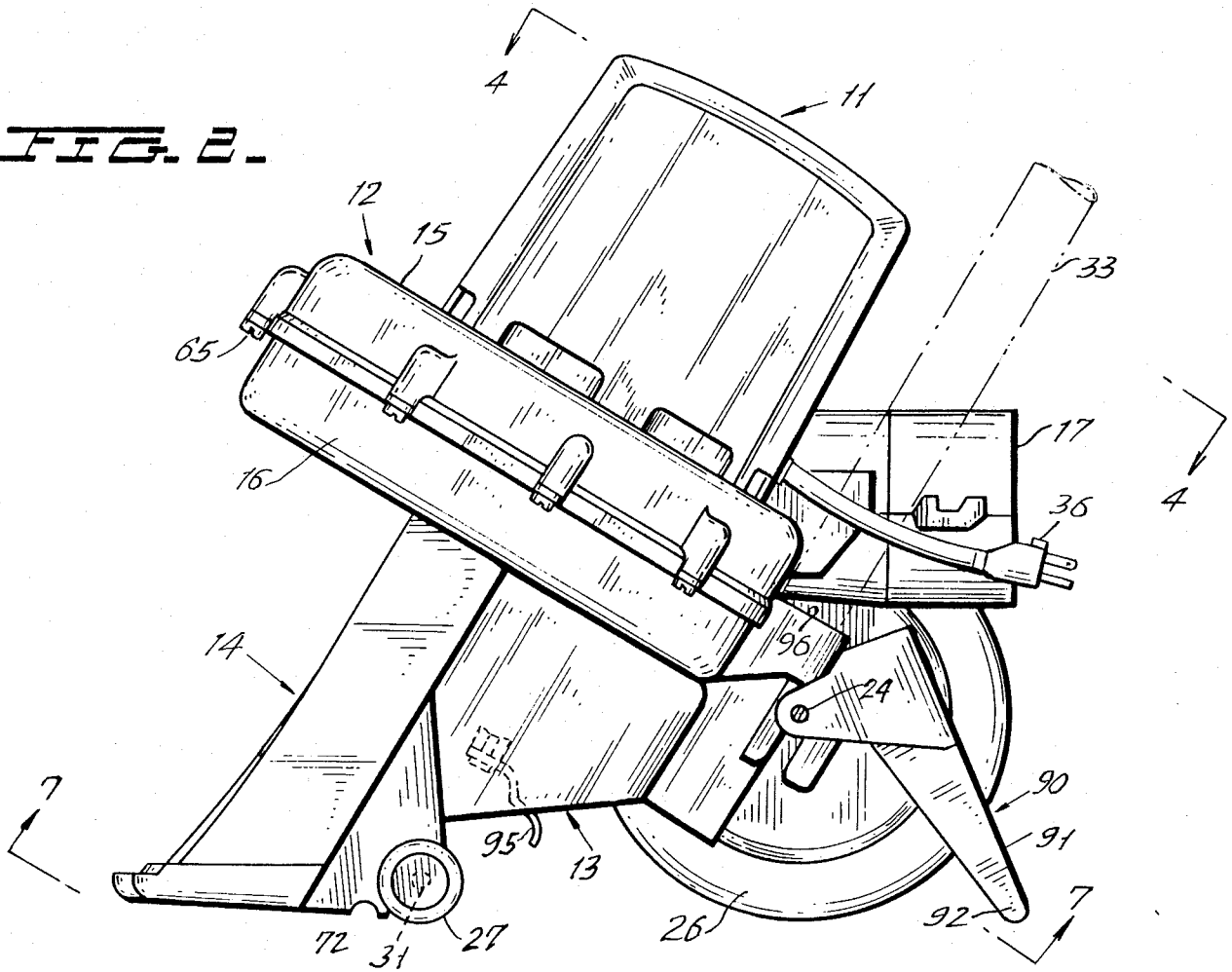
FIG. 2 is a left side elevation of the motor/fan/nozzle assembly, with the near load-bearing wheel removed and the stand in its active position.
Figure 3:
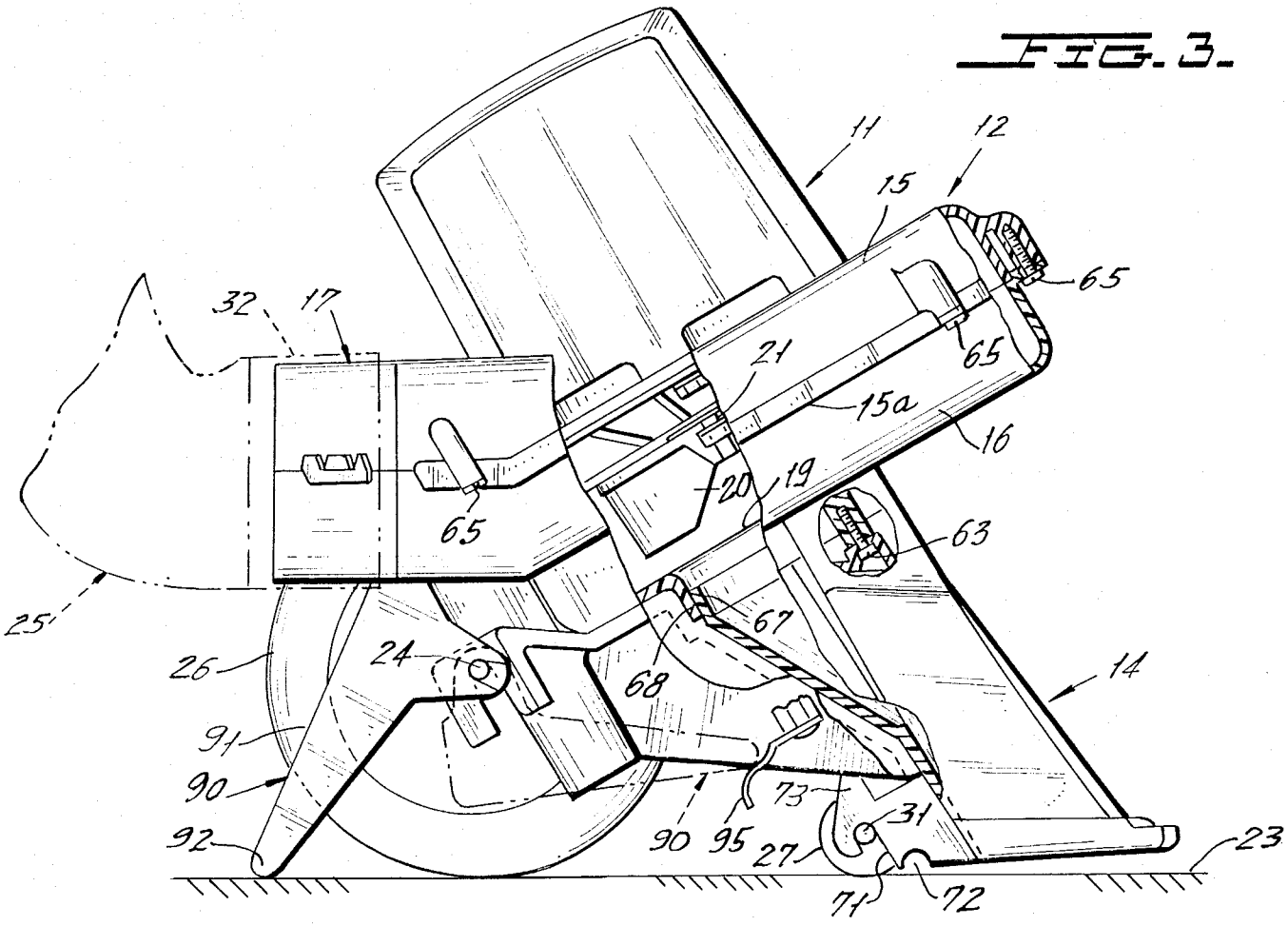
FIG. 3 is an elevation looking at the right side of the assembly of FIG. 2 with the right load-bearing wheel removed and housings partly cut away to reveal internal elements.
Figure 4:
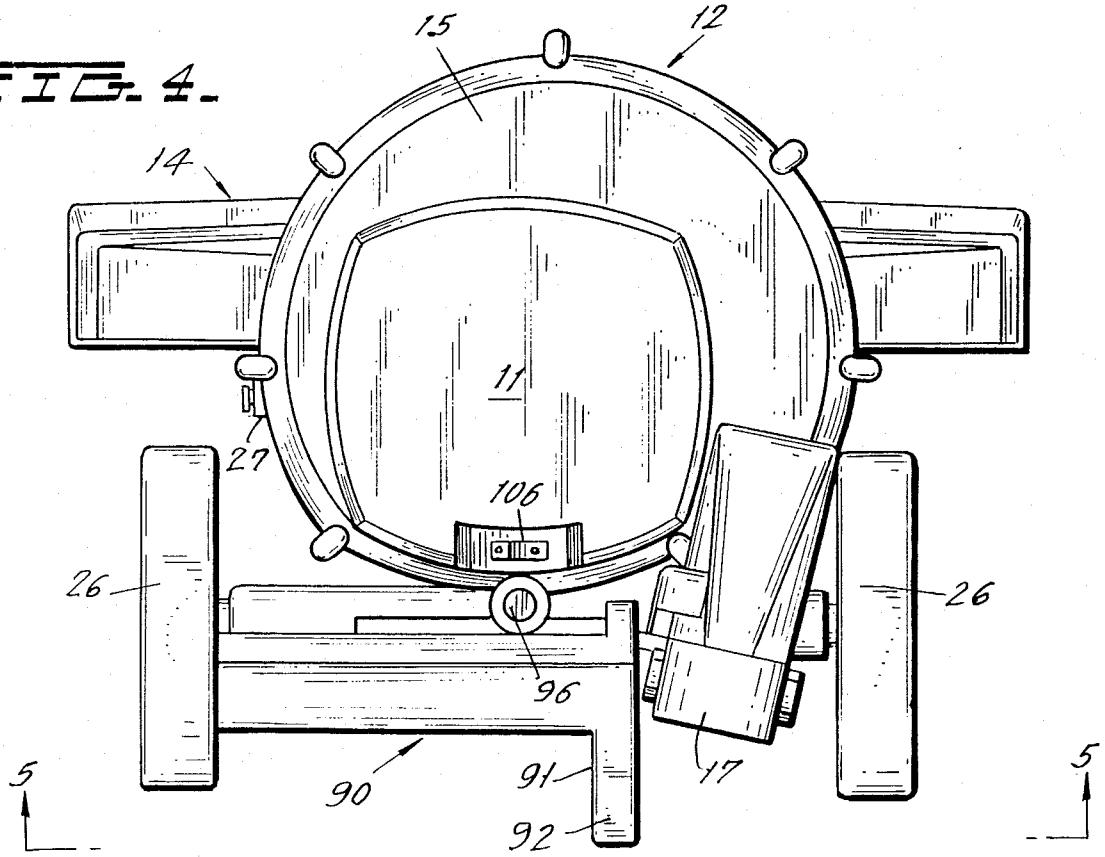
FIG. 4 is a plan view of the assembly of FIG. 2 looking in the direction of arrows 4—4 in FIG. 2.
Figure 7:
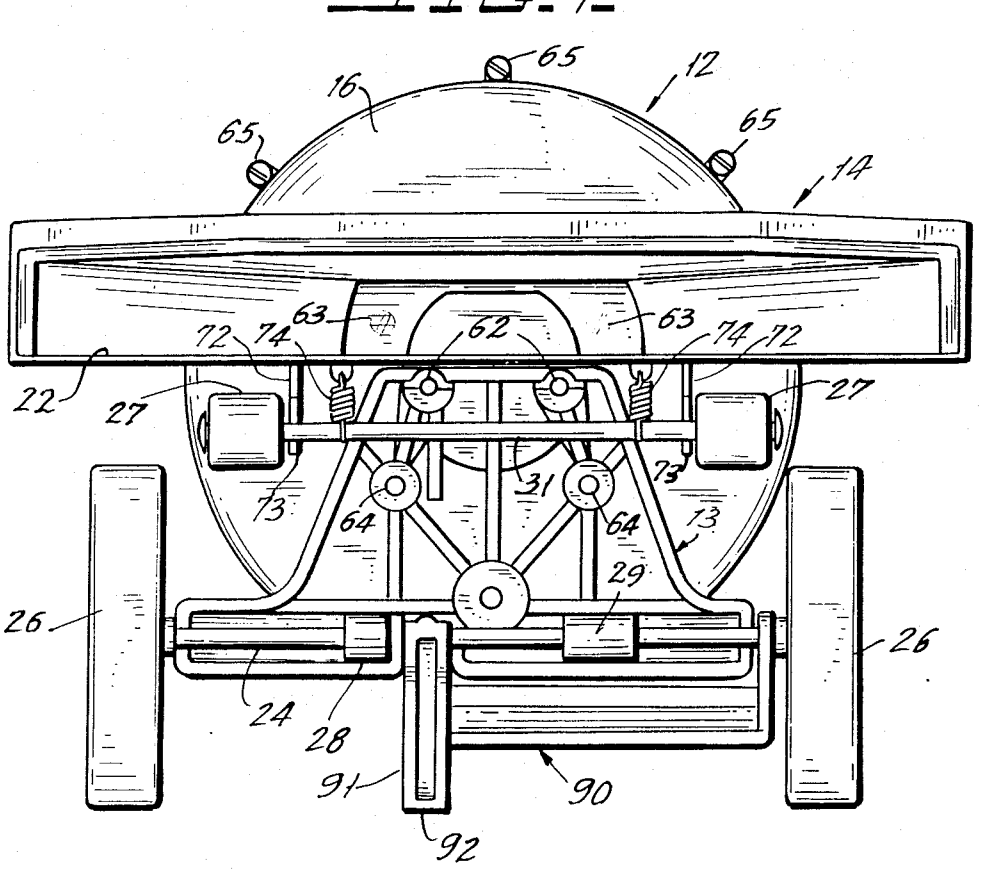
FIG. 7 is a bottom view of the assembly of FIG. 2 looking in the direction of arrows 7—7 in FIG. 2.

Now referring to the Figures, with FIG. 1 illustrating vacuum cleaner 10 which is constructed in accordance with teachings of the instant invention. Vacuum cleaner 10 includes motor 11 mounted to the top of generally circular housing 12 which in turn is mounted to the top of base 13. Nozzle unit 14 is mounted to base 13 at the front thereof and communicates with chamber 19 (FIG. 3) formed through the cooperation of upper and lower portions 15, 16 of housing 12. The exit for chamber 19 is provided by rearward extension 17 that terminates in circular exit 18 which is positioned to the rear of base 13. In a manner well-known to the art, suction producing fan impeller 20 disposed within chamber 19 is secured to the lower end of the generally vertical output shaft 21 of motor 11, and upon rotation of impeller 20 air is drawn upward into nozzle 14 through the transverse elongated entrance 22 thereof (FIG. 7). The latter is disposed adjacent to the generally horizontal surface or ground 23 on which two pair of wheels 26, 27 rest to support vacuum cleaner 10.

Air that is drawn into nozzle 14 through entrance 22 thereof, exits through narrowed upper end 67 and enters chamber 19 at the center thereof through an opening surrounded by downwardly extending lip 68 of lower housing section 16. Lip 68 overlaps the free end of upper end 67 on the outside thereof. Within chamber 19 air is directed radially outward by fan impeller 20 to leave housing 12 through exit 18 at the rear of housing extension 17. Removably secured to extension 17 by coupling 32 is porous container or bag 25 wherein debris carried by the air that is expelled through exit 18 is collected. This debris is emptied from bag 25 through a relatively large zipper closed opening (not shown). Coupling 32 is at the bottom of bag 25 whose upper end is secured to hollow handle extension 33 near the upper free end thereof, in a manner to be hereinafter explained. Extension 33 projects upwardly from circular recess 96 open at the top of base 13 and extends beyond the rear of base 13. The free end of extension 33 is provided with handle 34 which the operator grasps to move vacuum cleaner 10 back and forth on surface 23.

Figure 5:
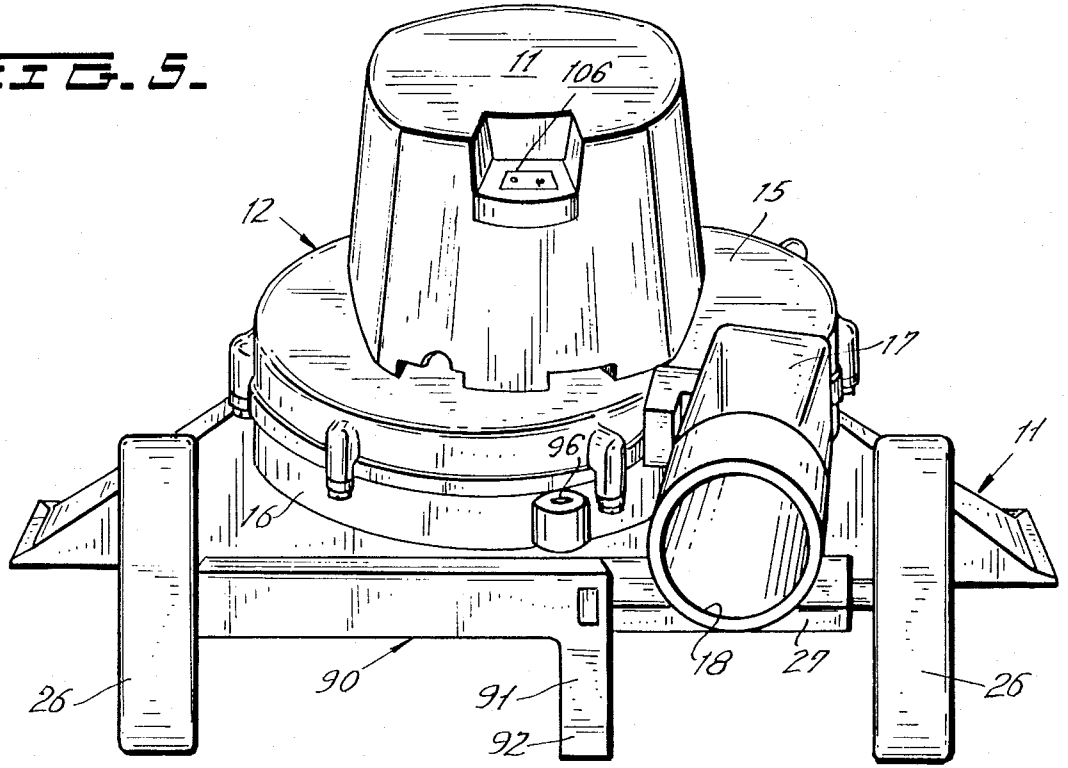
FIG. 5 is a rear elevation of the assembly of FIG. 4 looking in the direction of arrows 5—5 in FIG. 4.
Figure 6:
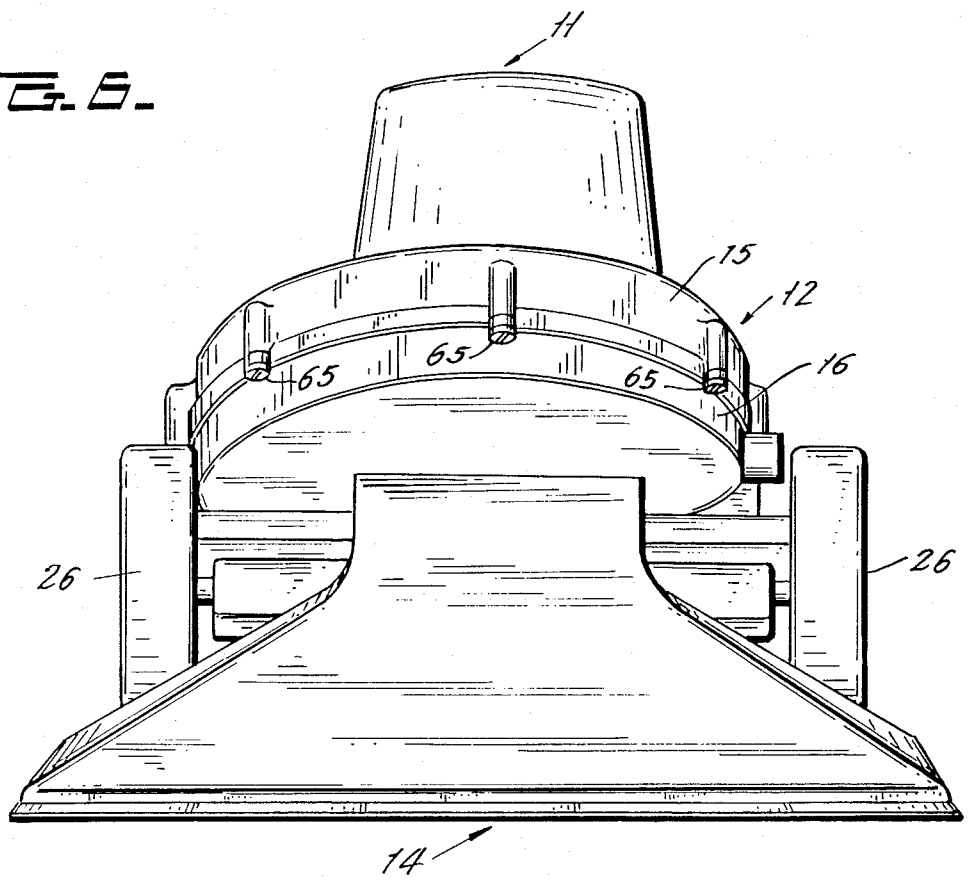
FIG. 6 is a front elevation of the assembly of FIG. 5.

Multiprong male connector or plug 36 is mounted to the free end of short cable 38 that is connected in circuit with motor 11 through normally open control switch 35 and cable 39 (FIG. 9) that extends through handle extension 33. A short length of cable 39 at the end thereof remote from switch 35 extends outside of handle extension 33 at the lower end thereof and mounts two prong plug 105 that is received by receptacle 106 which is accessible at the outside of the housing for motor 11 (FIG. 5). The prongs of plug 36 are received by receptacle or female connector 37 that is disposed at one end of line cord 40 whose other end is provided with male connector 99 that is to be plugged into a receptacle (not shown). Line cord 40 extends upward from plug 36 and is looped partially around strain relief post 44 after passing through guide aperture 43. Handle 34 is the downwardly offset portion at the rear of handle unit 45 that is secured to the upper end of extension 33.

Figures 8, 9:
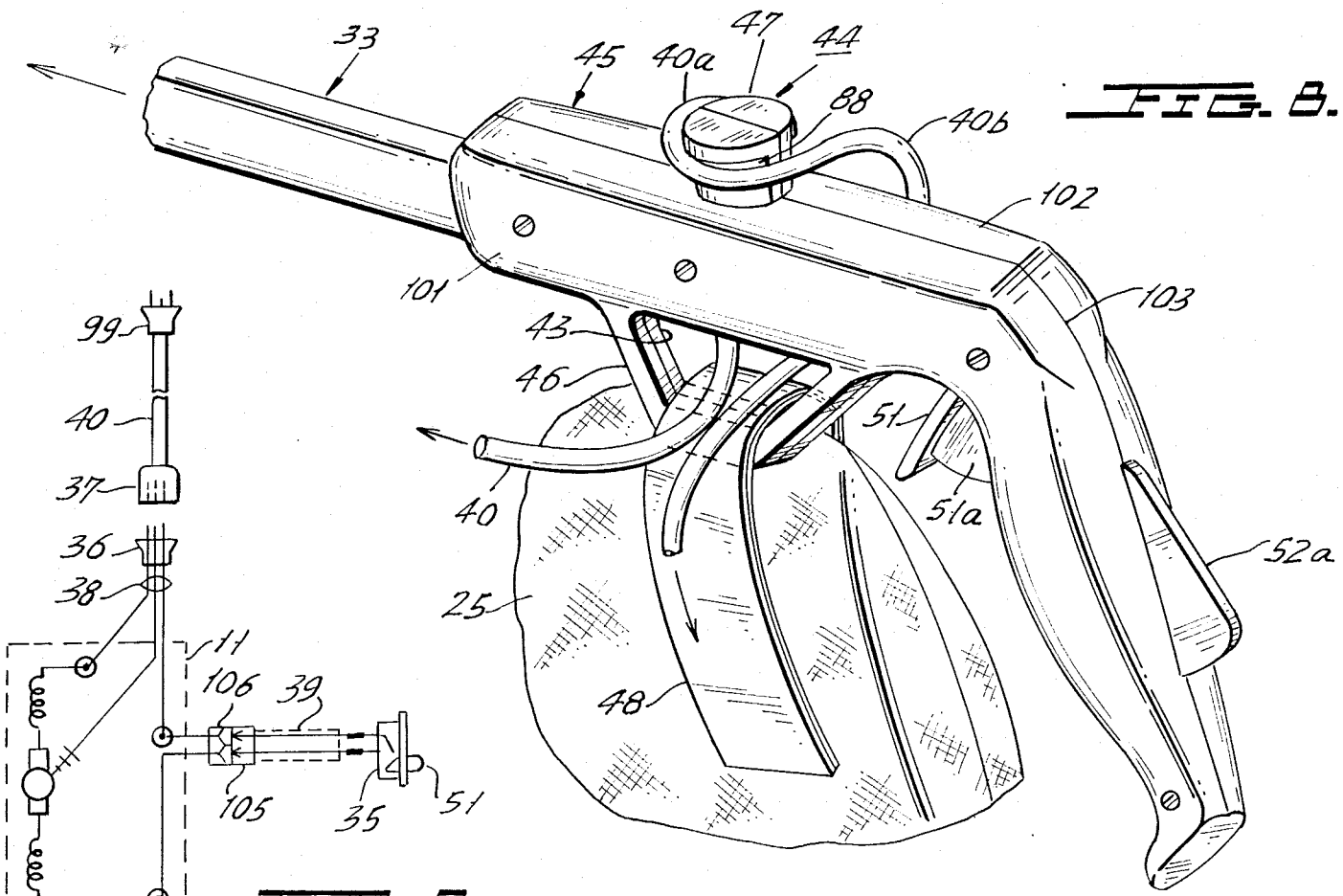
FIG. 8 is an enlarged fragmentary perspective looking generally at one side of the handle, the line cord strain relief and other elements mounted in proximity to the handle.
FIG. 9 is an electrical schematic.

Unit 45 includes a generally L-shaped molded plastic housing formed through the cooperation of elements 101, 102 that mate along line 103 (FIG. 8). Strain relief anchor 44 projects from one side of unit 45 while generally U-shaped formation 46 which projects from the opposite side of unit 45 defines guide aperture or eye 43 through which a double thickness **40*a*, 40*b* of line cord 40 extends before passing around strain relief anchor 44. With particular reference to FIG. 8 it is seen that double thickness cord 40*a*, 40*b* passes from left to right below unit 45 and through guide aperture 43, is reversely bent at the right or far side of unit 45, and a single thickness of cord 40 passes around the left side of strain relief anchor 44. Enlargement 47 at the free end of anchor 44 establishes groove 88 which facilitates retention of cord 40 on anchor 44**.

Tab 48 at the upper end of bag 25 also extends through guide aperture 43, and loops around formation 46 to secure the upper ends of bag 25. The loop formed by tab 48 is maintained closed by a separable fastening means such as the loop and cooperating nylon hook material of the general type disclosed in U.S. Pat. No. 3,365,757 issued Jan. 30, 1968 to J. Billarant for Flexible Band Fitted With Hooked Elements of the Filament Type This type of fastening means is marketed under the trademark VELCRO registered in the United States by Velcro U.S.A., Inc.

Figure 8A:
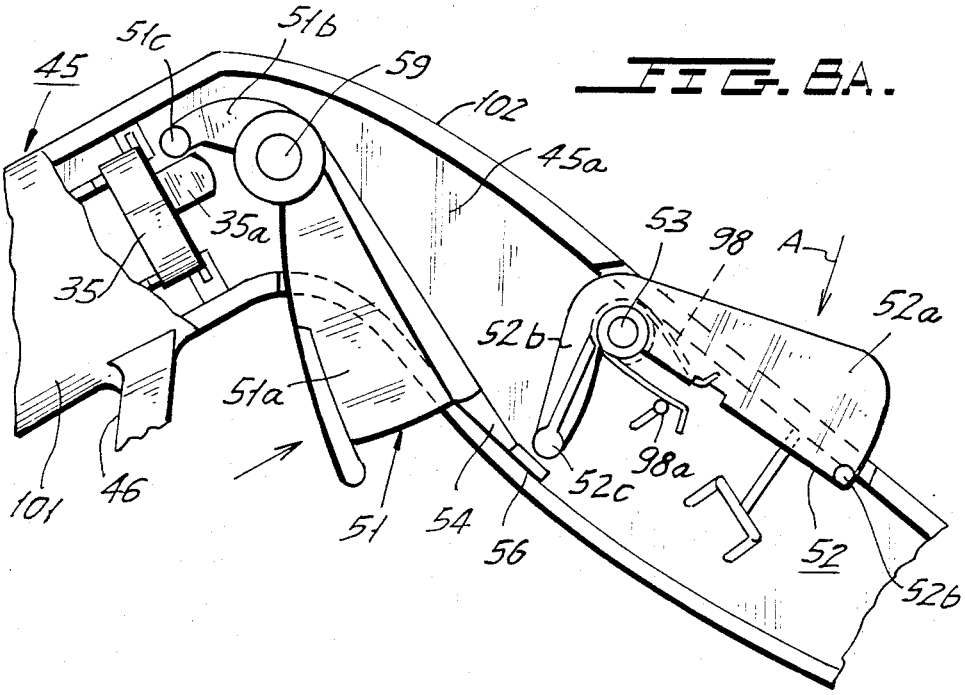
FIGS. 8A and 8B are each a fragmentary portion of the handle with the rear wall partially cut away to reveal the cooperation between switch operating and safety levers.

Trigger-like manual operating member 51 for control switch 35 is disposed for operation by the index finger of a hand that grasps the handle which is provided by the free end of housing 102, 103. However, operating member 51 cannot be retracted or depressed to close normally open switch 35 unless safety lever 52 has been and is retracted. That is, lever 52 is pivotally mounted on post 53 disposed within chamber **45*a* formed between housing elements 101, 102, and includes two angularly displaced radial arms 52*a*, 52*b*. Arm 52*b* is completely concealed within chamber 45*a* and the major portion of arm 52*a* normally projects outside of chamber 45*a* at the top of unit 45 (FIG. 8A). In this position of safety lever 52, free end 52*c* of arm 52*b* is aligned with free end 56 on that portion of trigger lever arm 51*a* which is normally concealed within chamber 45*a*. Lever 51 is pivotally mounted on post 59 within chamber 45*a* and includes another arm 51*b* that is fully concealed within chamber 45*a* and is angularly displaced from arm 51*a*. Free end 51*c* of arm 51*b* is aligned with slide 35*a* of normally open operating switch 35 to operate slide 35*a* downward for closing switch 35** when trigger is manually pivoted counterclockwise with respect to FIG. 8A, from the open switch position thereof to the closed switch position of FIG. 8B.

Torsion spring 98, wound around post 53 and having opposite ends engaged between post **98*a* and arm 52*a*, biases safety lever 52 counterclockwise with respect to FIG. 8A to its blocking position of FIG. 8A wherein arm 52*a* projects from chamber 45*a*. This position for lever 52 is established by stop 52*b* which projects sideways from arm 52*a* and engages the inside surface of the wall defining chamber 45*a*. In this position of safety lever 52, lever end 52*c* thereof is adjacent free end 54 of operating lever arm 51***a* to establish a blocking relationship between levers 51, 52 that prevents the former from being moved counterclockwise to close switch 35.

Figure 8B:
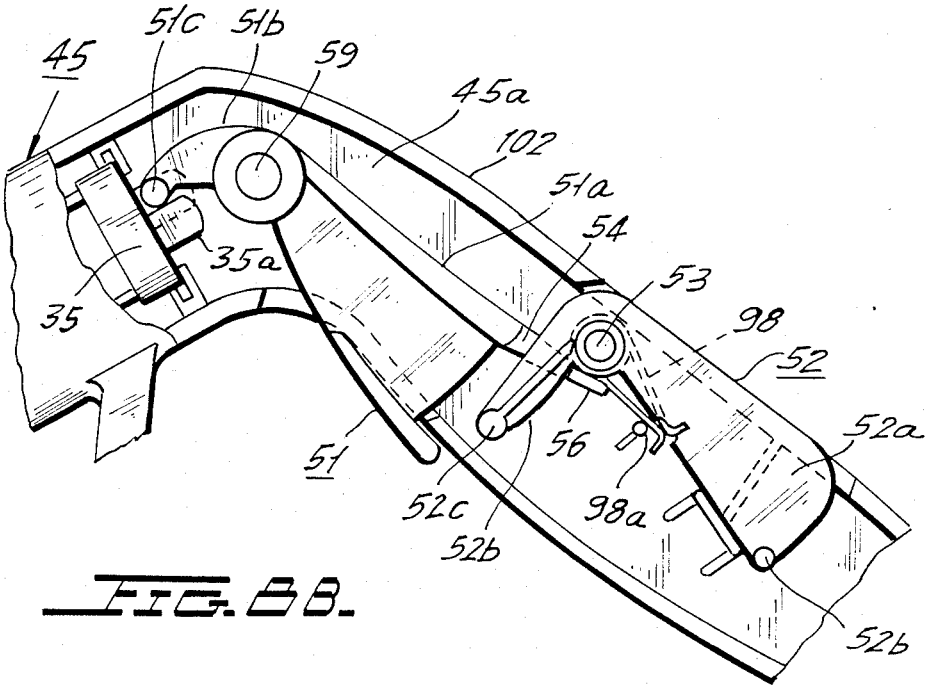
Figure 8L:
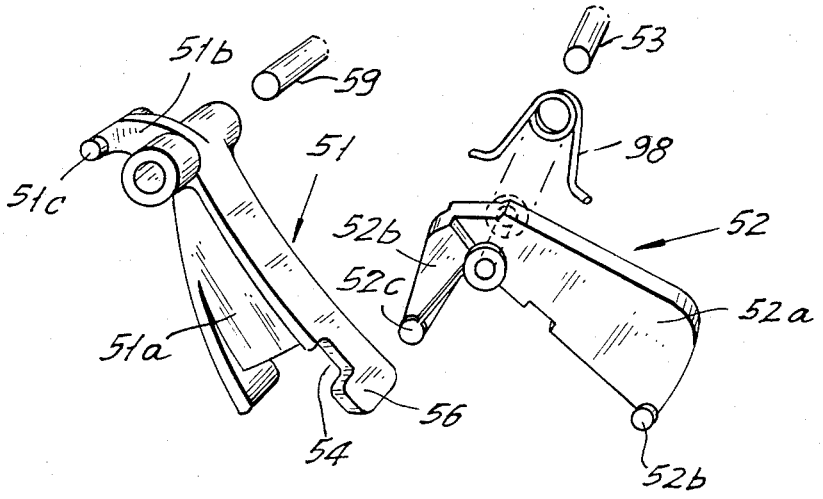
FIG. 8C is an exploded perspective of the operating and safety levers.

When the free end portion of unit 45 is grasped by a hand, the latter engages arm 52*a* and pivots safety lever 52 clockwise to its inactive position of FIG. 8B wherein lever end 52*c* is aligned with notch 54. This permits operating lever 51 to be moved counterclockwise, with arm 52*b* moving in notch 54 and lever end 51*c* moving down to drive slide 35*a* downward to close switch 35 and energize motor.

Two screws 62 secure nozzle 14 to base 13; two screws 63 secure nozzle 14 to lower housing member 16; two screws 64 secure base 13 to lower housing section 16; four screws 66 secure motor 11 to the top of upper housing section 15; and eight screws 65 secure housing sections 15, 16 together, with lip 15*a* of upper housing section 15 partially overlapping lower housing section 16 on the outside thereof. Large load-bearing wheels 26 are mounted on opposite ends of transverse shaft or axle 24 which is captured by formations 28, 29 (FIG. 7) at the underside and rear of base 13. Small height control wheels 27 are mounted at opposite ends of transverse shaft 31 and are disposed in the vicinity of the entrance or mouth 22 of nozzle 14 to maintain the height or proximity of mouth 22 with respect to surface 23. Height control wheels 27 are adjustably positionable by selectively inserting their shaft 31 in either of two sets of indexing notches 71, 72 that are open along the bottom edge of each extension 73 that projects from nozzle 14. Two coiled tension springs 74 are each attached between nozzle 14 and shaft 31 to bias the latter upwardly to a firm seating position within the selected notches 71, 72.

In order to prevent rolling of vacuum cleaner 10 when it is not being used and to stabilize same at that time against tilting rearward about shaft 24 because there is a heavy accumulation of debris within bag 25 which moves the center of gravity to the rear of axle 24, vacuum cleaner 10 is provided with kickstand 90 which is pivotally mounted on shaft 24. Stand 90 includes extension 91 having a free end or tip 92 which rests against floor 23 when stand 90 is in its active position shown in solid lines in FIG. 3. The center of gravity for stand 90 is located in a position such that when vacuum cleaner 10 is tipped forward sufficiently so that tip 92 can clear ground 23, gravity will cause stand 90 to pivot countercockwise with respect to FIG. 3 about shaft 24 as a center, and initially tip 92 moves downward in an arc. By the time tip 92 is vertically aligned with shaft 24, sufficient momentum has been developed so that stand 90 continues to move counterclockwise until tip 92 deflects retaining spring 95 and reaches its active or storage position shown in phantom in FIG. 3. In this position tip 92 is captured by spring 95 and is positioned thereabove. The latter is a leaf element that is secured to base 13 at the bottom thereof. In its inactive position tip 92 will not interfere with vacuum cleaner 10 being moved along surface 23.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A vacuum cleaner including:

a base;

a nozzle having an elongated inlet disposed below said base;

a suction producing fan means on said base comprising a motor, an impeller rotated by said motor, a chamber wherein said impeller rotates, said chamber having an inlet communicating with said nozzle and an outlet through which air is expelled from said chamber;

load bearing wheel means on said base to support said vacuum cleaner while it is moved along a floor;

an extension projecting upward and rearward from said base;

a handle on said extension at its upper end;

an electrical connector first section connected to said motor;

a line cord having electrical connector second and third sections at opposite ends thereof, said first and second sections being separably connected to each other;

strain relief means on said extension in the vicinity of said handle;

said strain relief means including a guide opening through which a double section of said line cord extends from a first side of said extension to a second side thereof opposite said first side, and an anchor around which a portion of said line cord disposed on the second side of said extension, said double section extends after being reversely bent, on the second side of said extension.

2. A vacuum cleaner as set forth in claim 1 also including a porous receptacle to collect debris that is drawn into said nozzle through said elongated inlet;

said receptacle having an entrance at its lower end, which entrance is operatively connected to said outlet to admit debris laden air expelled from said chamber into said receptacle;

said receptacle having its upper end secured to said extension in the vicinity of said guide opening.

3. A vacuum cleaner as set forth in claim 2 in which the receptacle on the outside and said upper end thereof is provided with a tab and separable fastening means which normally holds said tab to form a closed loop that extends around a formation that defines part of said guide opening to secure said upper end of said receptacle to said extension.

4. A vacuum cleaner as set forth in claim 2 in which the anchor is squat and extends generally upward from said extension, and said guide opening being below said anchor.

5. A vacuum cleaner as set forth in claim 4 in which the receptacle on the outside and said upper end thereof is provided with a tab and separable fastening means which normally holds said tab to form a closed loop that extends around a formation that defines part of said guide opening to secure said upper end of said receptacle to said extension.

6. A vacuum cleaner as set forth in claim 5 in which the anchor at its free end is provided with an enlarged head.

7. A vacuum cleaner as set forth in claim 5 in which the separable fastening means comprises velcro-like material.

8. A vacuum cleaner as set forth in claim 1 also including a control switch on said extension disposed for operation by a hand that is engaged with said handle;

said switch being in circuit with said line cord and said motor; and being biased open so that said motor is normally deenergized.

9. A vacuum cleaner as set forth in claim 8 in which said switch is disposed between said handle and said strain relief means;

a blocking device biased to a normal blocking position wherein said switch is prevented from opening;

said blocking device being operable manually to an inactive position wherein said switch may be closed to energize said motor.

10. A vacuum cleaner including:

a base;

a nozzle having an elongated inlet disposed below said base;

a motor, a suction producing fan means on said base comprising an impeller rotated by said motor, a chamber wherein said impeller rotates, said chamber having an inlet communicating with said nozzle and an outlet through which air is expelled from said chamber;

load bearing wheel means on said base to support said vacuum cleaner while it is moved along a floor;

an extension projecting upward and rearward from said base;

a handle on said extension at its upper end;

first means defining a transverse axis about which said load bearing wheel means rotates;

said axis being disposed behind the elongated inlet of said nozzle;

a stand for stabilizing said vacuum cleaner against rearward tilting when said vacuum cleaner is not being used;

said stand being mounted on said base for movement between a storage position and an active position;

said stand including a floor engaging portion that is disposed to the rear of said transverse axis when said stand is in said active position to stabilize said vacuum cleaner while it is not being used.

11. A vacuum cleaner as set forth in claim 10 also including a releasable catch for holding said stand in said storage position while said vacuum cleaner is in use.

12. A vacuum cleaner as set forth in claim 11 in which the catch comprises a spring element on said base that engages said floor engaging portion to hold said stand in said storage position.

13. A vacuum cleaner as set forth in claim 10 in which said stand is gravity operated from said active position to said storage position.

14. A vacuum cleaner as set forth in claim 13 also including a releasable catch for holding said stand in said storage position while said vacuum cleaner is in use;

said catch comprising a spring element on said base that engages said floor engaging portion to hold said stand in said storage position.

15. A vacuum cleaner as set forth in claim 14 in which said stand is mounted to said base for movement about a horizontal pivot axis, and as said stand moves between said storage and active positions said floor engaging portion moves through a generally vertical plane in which said pivot axis is disposed; said catch being disposed forward of the vertical plane; and with said stand in said active position said floor engaging portion being disposed rearward of the vertical plane.

16. A vacuum cleaner as set forth in claim 15 in which the transverse axis coincides with the pivot axis.

17. A vacuum cleaner as set forth in claim 16 also including:

an electrical connector first section connected to said motor;

a line cord having electrical connector second and third sections at opposite ends thereof, said first and second sections being separably connected to each other;

strain relief means on said extension in the vicinity of said handle;

said strain relief means including a guide opening through which a double thickness of said line cord extends and an anchor around which said double thickness extends after being reversely bent.

18. A vacuum cleaner as set forth in claim 17 also including a porous receptacle to collect debris that is drawn into said nozzle through said elongated inlet;

said receptacle having an entrance at its lower end, which entrance is operatively connected to said outlet to admit debris laden air expelled from said chamber into said receptacle said receptacle having its upper end secured to said extension in the vicinity of said guide opening 19. A vacuum cleaner as set forth in claim 18 also including a control switch on said extension disposed for operation by a hand that is engaged with said handle;

said switch being in circuit with said line cord and said motor, and being biased open so that said motor is normally deenergized;

said switch being disposed between said handle and said strain relief means;

a blocking device biased to a normal blocking position wherein said switch is prevented from opening;

said blocking device being operable manually to an inactive position wherein said switch may be closed to energize said motor.

20. A vacuum cleaner as set forth in claim 19 in which the blocking device includes a pivotally mounted lever having an arm that is biased to normally project outside of said handle and when so positioned is depressible to a retracted position by a hand as it engages said handle, with said arm depressed said blocking device being in it said active position.

21. A vacuum cleaner as set forth in claim 10 also including height control wheel means on said base in close proximity to the elongated inlet to maintain its height above ground; and repositioning means mounting said control wheel means to selectively establish the height of said elongated inlet above ground.

* * * * *